United States Patent [19]

Noakes

[11] Patent Number: 4,708,323

[45] Date of Patent: Nov. 24, 1987

[54] FENCE ATTACHMENT

[76] Inventor: Larry R. Noakes, 21155 SW. Sandra La., Aloha, Oreg. 97006

[21] Appl. No.: 927,913

[22] Filed: Nov. 6, 1986

[51] Int. Cl.[4] ..... B21F 27/00

[52] U.S. Cl. ..... 256/35; 256/34

[58] Field of Search ..... 256/35, 34, 52; 174/146

[56] References Cited

U.S. PATENT DOCUMENTS

| | | | |
|---|---|---|---|
| 353,129 | 11/1886 | Gholson . | |
| 495,076 | 4/1893 | Walling et al. | 256/35 |
| 568,945 | 10/1896 | Gross . | |
| 753,892 | 3/1904 | Lerch | 256/35 X |
| 1,136,471 | 4/1915 | Leilich et al. . | |
| 3,342,168 | 9/1967 | Burdette | 174/146 X |
| 3,671,017 | 6/1972 | Sachs . | |
| 3,916,089 | 10/1975 | Sloan | 174/175 X |

FOREIGN PATENT DOCUMENTS

| | | | |
|---|---|---|---|
| 417922 | 2/1967 | Switzerland | 256/52 |

*Primary Examiner*—Andrew V. Kundrat

*Attorney, Agent, or Firm*—Henderson & Sturm

[57] ABSTRACT

A fence of a type including two posts secured to the ground and at least two wires extending between the posts. One of the wires is spaced above the other by a predetermined distance. An elastomeric elongated member having a front edge, a rear edge parallel to the front edge, top and bottom edges and two parallel sides has a wire holding structure at the top and bottom ends thereof. A small slot associated with each wire holding structure has a length narrower than the diameter of the wire so that it must be deformed in order to get the wire therethrough. Consequently, the fence attachment can be snapped onto two strands of wire without a danger that it will come unfastened.

1 Claim, 9 Drawing Figures

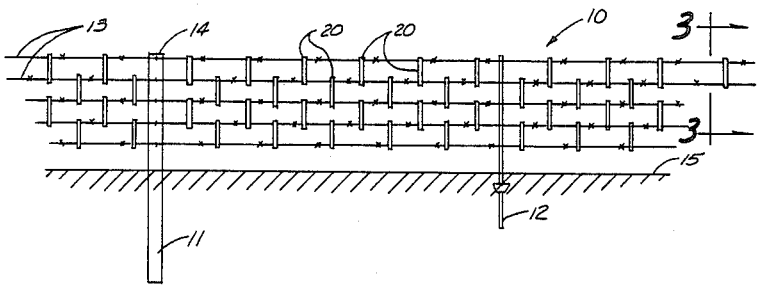
Fig. 1
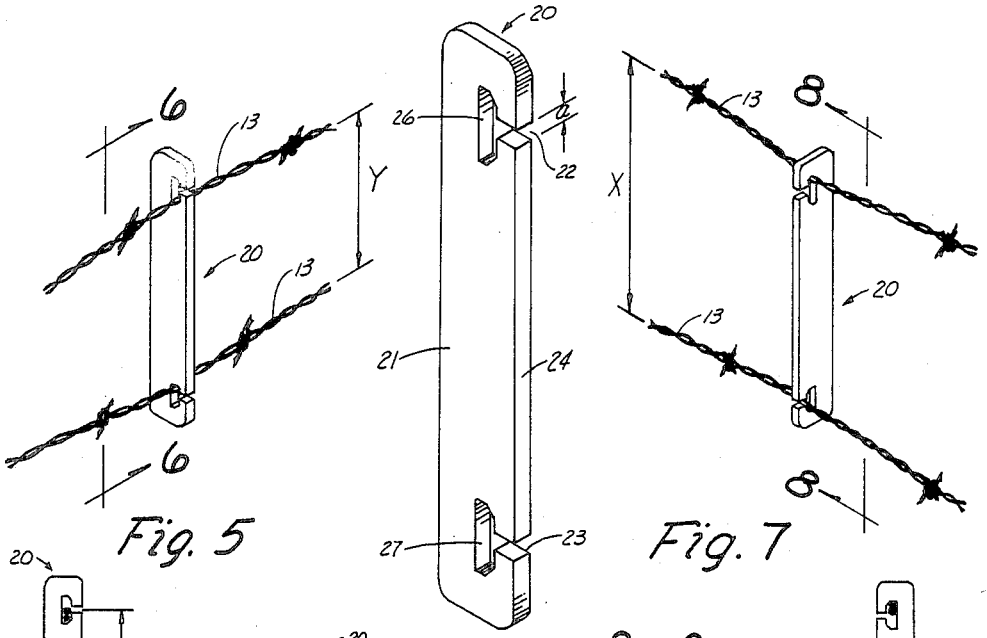
Fig. 5
Fig. 2
Fig. 7
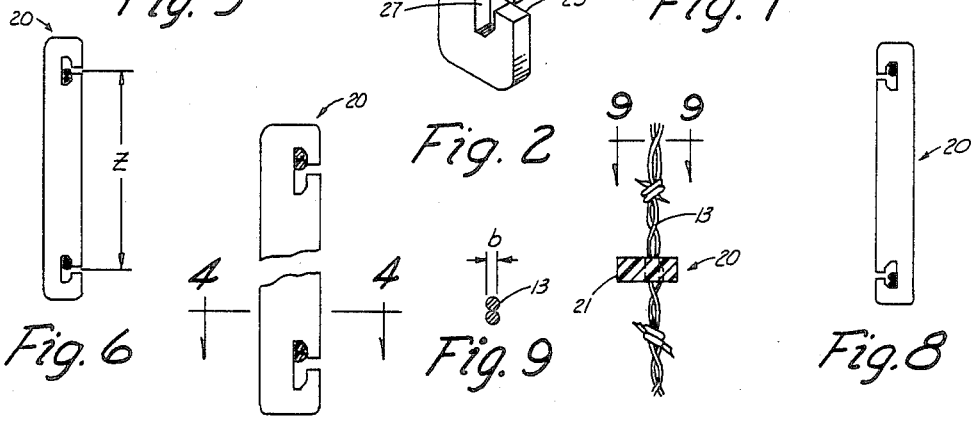
Fig. 6
Fig. 3
Fig. 9
Fig. 4
Fig. 8

FENCE ATTACHMENT

TECHNICAL FIELD

The present invention relates generally to fence attachments, and more particularly to such a fence attachment for the purpose of holding the wires from separating on livestock fences.

BACKGROUND ART

The most common type of fencing for restraining livestock such as cattle, horses, sheep or the like is a barbed wire fence nailed to wooden posts or attached by wires to metal posts. The barbed wire fences have three or four strands of wire, one above the next, but they may have more wires depending upon the heighth desired or the size of the animals which might try to squeeze through the strands of wires.

In a fence of the aforementioned type, it is not uncommon for the animals being restrained to stick their heads through adjacent strands of wire to eat grass or the like on the other side of the fence. When this happens, the wires become stretched and loose and sometimes cause the fasteners on the posts to become loose or to be disengaged from the posts or the wire altogether. Consequently, especially because of the pressure of the livestock on the fence, a fence must be checked periodically and repaired as needed. To the extent that a fence is good enough to prevent the livestock from sticking their head through it, it will need less repair, less tightening and less checking.

Consequently there is a need for a fence of the aforementioned type which will overcome the aforementioned problems associated therewith Disclosure of the Invention The present invention relates to a fence of a type including two posts secured to the ground and at least two wires extending between the posts. One of the wires is spaced above the other by a predetermined distance. An elastomeric elongated member having a front edge, a rear edge parallel to the front edge, top and bottom edges and two parallel sides has a wire holding structure at the top and bottom ends thereof. A small slot associated with each wire holding structure has a length narrower than the diameter of the wire so that it must be deformed in order to get the wire therethrough. Consequently, the fence attachment can be snapped onto two strands of wire without a danger that it will come unfastened An object of the present invention is to provide an improved livestock fence.

Another object of the present invention is to provide an attachment for wire livestock fences which will hold strands of wire from being separated and therefrom tend to prevent livestock from sticking their head and neck through and between strands of wire Another object of the present invention is to provide a fence attachment of the aforementioned type which is adaptable to fences having various distances between the strands of wire.

Other objects, advantages, and novel features of the present invention will become apparent from the following detailed description of the invention when considered in conjunction with the accompanying drawings.

BRIEF DESCRIPTION OF THE DRAWINGS

FIG. 1 is a side elevational view of a fence having the attachment of the present invention attached thereto;

FIG. 2 is an enlarged perspective view of a fence attachment constructed in accordance with the present invention;

FIG. 3 is a cross sectional view taken along line 3—3 of FIG. 1 and shows a situation where the wires are the same distance apart as the slots in the fence attachment;

FIG. 4 is a cross sectional view taken along line 4—4 of FIG. 3;

FIG. 5 is a perspective view of two strands of barbed wire fence which are closer together than the distance between the slots in the fence attachment;

FIG. 6 is a cross sectional view taken along line 6—6 of FIG. 5;

FIG. 7 is a perspective view of the fence attachment of the present invention attached to a barbed wire fence having the strands spaced apart more than the distance between the slots in the fence attachment; and FIG. 8 is a cross sectional view taken along line 8—8 of FIG. 7.

BEST MODE FOR CARRYING OUT THE INVENTION

Referring now to the drawings wherein like reference numerals designate identical or corresponding parts through the several views, FIG. 1 shows a fence (10) constructed in accordance with the present invention. The fence (10) includes a first post (11) made of wood and a second post (12) made of steel and having a plurality of strands of barbed wire (13) stretched therebetween. Typically metal staples (14) are used to attach the barbed wire (13) to the wooden post (11) and wire fasteners, not shown, attach the barbed wire (13) to the metal post (12). The posts (11) and (12) are secured into the ground (15), as shown in FIG. 1.

The present invention relates to a fence attachment (20) which is attached between adjacent strands of barbed wire (13) as shown in FIG. 1. This fence attachment (20) is shown in greater detail in FIG. 2 and includes a flat elastomeric member (21) having an upper slot (22) and a lower slot (23) disposed in a front edge (24). For example, member (21) may be made of polyvinylchloride. The slot (22) has a length "a" which is narrower than the diameter "b" of the barbed wire shown in FIG. 9. Consequently, the barbed wire can be forced through the slots (22) and (23) by deforming the edges of the slot (22), and then once the barbed wire (13) is forced through the slots (22) it will be retained in an elongated opening (26). These elongated openings (26) and (27) can be seen in cross section in FIG. 3 to show the particular shape thereof.

FIG. 1 shows these fence attachments (20) attached to the barbed wire (13) of a fence to prevent animals from being able to separate adjacent wire (13) and stick their head therethrough. Fewer or more of the attachments (20) can be used than the number shown in FIG. 1, depending upon the desire of the user and the type and behavior of the animals being confined It is noted in FIG. 6 that the distance between the slots (22) and (23) are of a distance "z". Similarly, the distance between the wires (13) shown in FIG. 3 are likewise of a distance "z" so that once the wires (13) are forced through the slots (22) and (23), the fence attachment (20) will drop down over the wires (13) and even if there is pressure by the animals against such fence attachments (20), they will not pop off. Furthermore, it is desirable to put the fence attachments (20) on from the side in which the pressure is being exerted by the animals For example, looking to FIG. 1 it is noted that the wire (13) is on the inside as though the viewer were an animal being confined. Similarly, the slots (22) would be facing away from the viewer as viewed in FIG. 1 so that if an animal were to push on the fence attachments (20) they could not pop out through the slots (22) and (23). While the attachments (20) would work if they were reversed, it would be much better to apply them in the manner referred to above.

If it is desired to use the fence attachment (20) on a fence wherein the wires (13) are spaced apart a distance "y" which is less than the distance "z", between the slots (22) and (23), this can easily be accomplished by forcing the wires (13) through the slots wherein they will end up on the interior portion of the openings (26) and (27) and will tend to have a tightening affect on the wires (13) since the wires (13) will be pushed apart to some extent.

Conversely, on a fence wherein the wires (13) are spaced apart by a distance "x" which is greater than the distance "z", then the wires (13) will be pulled together somewhat after they have been installed, as is shown in FIG. 8, and under this arrangement the wires (13) will be tightened to some extent because of the pulling together of the barbed wires (13).

Accordingly, all of the foregoing objects will be achieved by the preferred embodiment disclosed herein. Obviously many modifications and variations of the present invention are possible in light of the above teachings. It is therefore to be understood that, within the scope of the appended claims, the invention may be practiced otherwise than as specifically described.

I claim:

1. In combination with a livestock confining fence of a type including at least two posts secured to the ground, at least two wires extending between said posts, one of the wires being spaced above the other wire by a predetermined distance, the improvement consists of:

an elastomeric elongated member having a front edge, a rear edge parallel to mid-front edge, top and bottom edges and two parallel sides, the distance between the sides being substantially less than the distance between the front and rear edges;

first holding means adjacent the top edges of said elongated member for receiving said one top wire, said first holding means comprising a first slot disposed in said front edge, the length of said first slot being less than the diameter of said one wire whereby said one wire can be forced through said first slot causing temporary deformation of the walls of said slot in the process, said first holding means including a first enlarged generally rectangular vertical opening between the sides of said elongated member, the first opening extending above and below said first slot and being located farther from the front edge of the elongated member than said first slot whereby said one wire will be held in said first opening after being forced through said first slot; and second holding means adjacent to the bottom edge of said elongated member for receiving said other wire, said second holding means comprising a second slot disposed in said front edge, the length of said second slot being less than the diameter of said other wire whereby said other wire can be forced through said second slot causing temporary deformation of the walls of said slot in the process, said second holding means including a second enlarged generally rectangular vertical opening between the sides of said elongated member, the second opening extending above and below said second slot and being located farther from the front edge of the elongated member than said second slot whereby said other wire will be held in said second opening after being forced through said second slot; the front edge of said elastomeric elongated member being engaged with said at least two wires and the rear edge of said elastomeric elongated member facing the enclosure defined by the livestock confining fence; wherein, the spacing between the slots is predetermined relative to the normal spacing between said two wires and the elastomeric material of said elongated member cooperates with said two wires, such that the wires may be compressed, tensioned or maintained in their disposition relative to one another.

* * * * *